US006711791B2

(12) United States Patent
Hess

(10) Patent No.: US 6,711,791 B2
(45) Date of Patent: Mar. 30, 2004

(54) SLIDE HAMMER TOOL AND METHOD OF REMOVING A KEEPER RING

(76) Inventor: Clint Hess, 300 Mark Ct., Neenah, WI (US) 54956

( * ) Notice: Subject to any disclaimer, the term of this patent is extended or adjusted under 35 U.S.C. 154(b) by 0 days.

(21) Appl. No.: 09/960,776

(22) Filed: Sep. 24, 2001

(65) Prior Publication Data

US 2002/0010994 A1 Jan. 31, 2002

Related U.S. Application Data

(63) Continuation-in-part of application No. 09/356,559, filed on Jan. 7, 1999, now abandoned.

(51) Int. Cl.[7] ..... B23P 19/00; B23P 19/04

(52) U.S. Cl. ..... 27/426.5; 29/229; 29/254; 29/255

(58) Field of Search ..... 29/426.5, 229, 29/254, 255; 37/352, 375, 462

(56) References Cited

U.S. PATENT DOCUMENTS 4,697,483 A * 10/1987 Rodgers ..... 81/418
4,873,754 A * 10/1989 Gleasman ..... 29/229
4,942,655 A * 7/1990 Buzzelli ..... 29/229
5,109,739 A * 5/1992 Hull et al. ..... 81/463
5,197,841 A * 3/1993 Tanaka ..... 411/522

FOREIGN PATENT DOCUMENTS

JP 408118253 * 5/1996

* cited by examiner

*Primary Examiner*—John C. Hong
(74) *Attorney, Agent, or Firm*—Donald Cayen

(57) ABSTRACT

A slide hammer tool is particularly useful for replacing worn teeth of a trenching machine. The teeth are retained in chain links of the trenching machine by respective open keeper rings. The tool has a rod with stops proximate both ends. A hammer is slidable on the rod between the stops. On one rod end is a wedge with converging surfaces that match radial surfaces on the keeper rings. The other end of the rod has a concave surface that matches the keeper ring outer diameter. To remove the keeper ring from a worn tooth, the wedge converging surfaces are abutted against the keeper ring radial surfaces. The hammer is rapidly struck against the corresponding stop. The impact of the hammer on the stop is transmitted to the wedge converging surfaces and to the keeper ring radial surfaces. The impact is sufficient to cause the keeper ring opening to expand, and the keeper ring is pushed off the tooth. After a new tooth is inserted into the chain link, the rod concave surface is abutted against the keeper ring outer diameter. The hammer is rapidly struck against the second stop. The impact produced is transmitted to the rod concave surface and to the keeper ring to seat the keeper ring on the new tooth.

18 Claims, 4 Drawing Sheets

37
39
40
41
43
45
47
51
52
53
55
57
59
61
63
65
67
69
71
72
73
75
78
79
81
83
29
X
T
A
A
65'
67'
69'
71'
39'

SLIDE HAMMER TOOL AND METHOD OF REMOVING A KEEPER RING

This application is a continuation-in-part of U.S. patent application Ser. No. 09/356,559 filed Jan. 7, 1999, now abandoned.

BACKGROUND OF THE INVENTION

1. Field of the Invention

This invention pertains to earth trenching equipment, and more particularly to apparatus for removing and installing trencher teeth.

2. Description of the Prior Art

Machines that cut trenches in the earth are subjected to severe operating conditions. That is especially true for the trencher teeth, which are carried in an endless track of chain links.

The trencher teeth are generally cylindrical in shape, having a head and a shank. The teeth are retained in respective collars in the chain links. The track is powered by the machine to move the teeth heads into direct sliding contact with soil, rocks, and water. That action imparts shock loads and abrasion to the teeth. For proper operation, it is important that the teeth rotate about their longitudinal axes as they are powered through the earth.

To increase the service lives of the teeth, their heads are usually hardened. In addition, it is well known to make the head working tips from a carbide material. Nevertheless, the teeth wear relatively rapidly, especially when used in rocky conditions. For economical operation of the trencher equipment, it is vital that a worn tooth be quickly replaced with a new tooth.

Prior trencher teeth were retained in the chain link collars by a band of thin resilient metal that fit loosely within a groove in the tooth shank. The band was cut through longitudinally, and the ends were spaced apart a short distance. Consequently, the band could collapse and expand radially. A number of small rounded bumps protruded from the band outer surface circumferentially around the band. The bumps of the uncollapsed band defined a circle having a diameter slightly larger than the diameter of the tooth shank. The prior trencher teeth were assembled to the chain link collars by inserting a tooth shank end into a close fitting hole in the collar until the band bumps contacted the collar. Then the tooth head was struck with a hammer or similar tool. The resulting impact on the tooth and the band bumps caused the band to radially collapse such that the bumps slid into the collar hole. The tooth was pushed into the collar until the band became aligned with a circumferential groove in the collar hole. At that point, the band resiliently returned to its original configuration, such that the bumps entered the collar groove. At that point, the tooth was firmly retained in the collar.

The prior tooth, band, and collar design was not entirely satisfactory. During operation, soil and small stones tended to become embedded in the tooth shank groove and in the collar groove. Consequently, the tooth seized in the collar and wore much faster than was tolerable.

A further disadvantage of the prior tooth design was that a worn tooth was difficult to remove. The design of the trenching machine chain links was such that the tooth could not be driven out from the shank end. The only way to remove the tooth was by using a forked puller tool. The fork was placed in a circumferential groove in the tooth head. A hard blow on the tool was required. That was because the pulling force had to be enough to collapse the band bumps from the collar groove. The tooth removal process was laborious and undesirably time consuming.

In an attempt to solve the problems associated with the band-type trencher teeth, a modified tooth with a longer shank was developed. The shank was long enough to extend completely through and emerge from the collar on the opposite side as the tooth head. A groove near the shank free end was exposed outside the collar. A heavy open keeper ring in the shank groove cooperated with the head to retain the tooth in the collar.

The new tooth design was an improvement. As one advantage, the tooth had a lesser tendency to seize in the collar.

However, installation and removal of the teeth remained difficult. The teeth shanks easily slid into the collar holes to expose the shank grooves, but the heavy and relatively rigid keeper rings were difficult to seat into and remove from the shank grooves. To seat a keeper ring, a mechanic was required to hold the keeper ring against the groove with one hand, usually using a pliers. He then struck the ring a hard blow, using a hammer, with his other hand. Ideally, the keeper ring would then instantaneously expand radially and slide fully into the groove. However, any misalignment of the keeper ring adjacent the tooth or inaccuracy of the hammer blow resulted in a failure to seat the keeper ring. In addition, the design of the trencher machine and track provided only limited space for the mechanic's hands to hold the keeper ring and to swing the hammer.

It was even more difficult to remove the keeper ring from a worn tooth. The only practical way to remove the keeper ring was by manually prying its two ends apart with a pair of screwdrivers or the like. The mechanic was required to manipulate the screwdrivers together as levers acting against the keeper ring open ends. The screwdrivers had to simultaneously spread the keeper ring and apart and pry the keeper ring out of the shank groove. That process, performed in a limited space, was frustrating and time consuming. It was not unusual for a person to waste 15 minutes manually prying off the keeper ring from a single tooth.

Thus, a need exists for improvements in the way teeth are installed into and removed from trenching machines.

SUMMARY OF THE INVENTION

In accordance with the present invention, a slide hammer tool is provided that greatly eases the task of seating an open keeper ring onto and removing it from a cylinder. This is accomplished by apparatus that includes a heavy hammer handle that slides along a rod having opposite ends configured to conform to the shape of radial end surfaces of the keeper ring.

There are first and second stops near the respective ends of the rod that limit the travel of the hammer along the rod. The rod first end has two flat surfaces that are immoveable relative to each other and that lie in respective planes that converge toward a longitudinal centerline. There is a generally U-shaped cutout in the converging surfaces that is symmetrical about the longitudinal centerline. The cutout includes an arcuate surface that preferably is continuous and uninterrupted. The radius of the cutout arcuate surface is slightly larger than the radius of the cylinder. If desired, the cutout and the converging surfaces can be formed in a separate piece that is rigidly held to the first end of the rod.

The second end of the rod is configured with a concave surface having the same diameter as the keeper ring outer diameter. The depth of the concave surface is slightly less than the radial thickness of the keeper ring.

To remove a keeper ring from a cylinder using the slide hammer tool of the invention, the tool first end is used. The rod converging surfaces are placed in abutting contact against corresponding radial end surfaces of the keeper ring. The hammer is slid rapidly against the tool first stop. The impact on the first stop is transmitted to the two keeper ring radial end surfaces simultaneously. The tool converging surfaces act as a rigid wedge to expand the keeper ring end surfaces. The impact is sufficient to push the keeper ring off the cylinder.

To use the slide hammer tool to seat a keeper ring on a cylinder, the open end of the keeper ring is placed against the cylinder. The concave surface of the tool second end is placed in abutting contact against the keeper ring outer diameter opposite the keeper ring open end. The hammer is slid rapidly along the rod to strike the second stop. The impact of the hammer on the second stop is transmitted to the keeper ring, forcing its end surfaces to expand and slide over the cylinder and then immediately close. The keeper ring is then seated on the cylinder.

The method and apparatus of the invention, using rod ends that conform to the shape of a keeper ring, thus greatly simplifies the task of seating the keeper ring onto and removing it from a cylinder. The keeper ring is under spatial control at all times during the seating and removing processes, even though it is subjected to high impacts from the hammer.

Other advantages, benefits, and features of the present invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
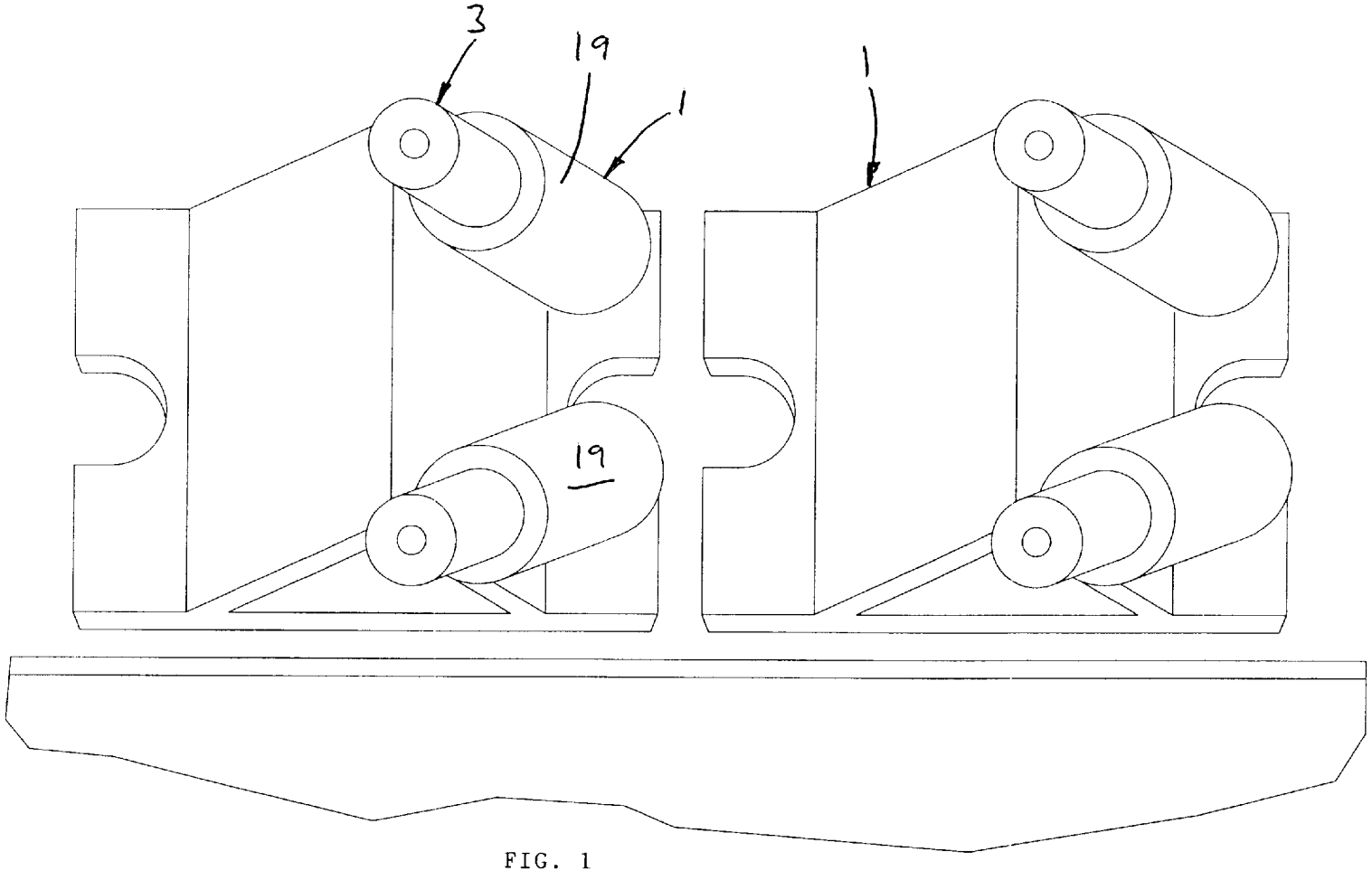
FIG. 1 is a perspective view of typical chain links of a trenching machine that include teeth that are installed and removed using the present invention.

FIG. 1 illustrates a few chain links 1 of an endless track of chain links of a typical trenching machine. As illustrated, each chain link 1 has two collars 19, and each collar removeably retains a tooth 3. The design, construction, and use of the trenching machine, chain links 1, and teeth 3 may be entirely conventional, and those components form no part of the present invention. Nevertheless, an understanding of the chain links and the teeth is necessary for an understanding of the invention.

Figure 2:
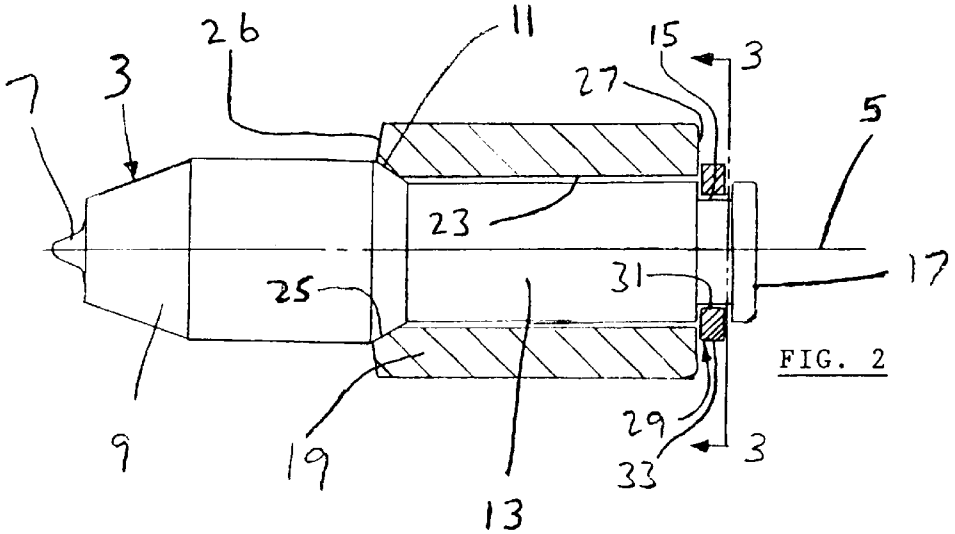
FIG. 2 is a cross-sectional view through a collar of a chain link and through a tooth in the collar.
Figure 3:
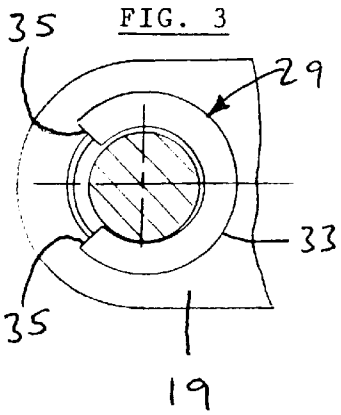
FIG. 3 is a cross-sectional view taken along line 3—3 of FIG. 2.

Also looking at FIGS. 2 and 3, each tooth 3 is generally cylindrical in shape, having a longitudinal axis 5. One end of the tooth has a carbide tip 7. The carbide tip 7 is brazed or otherwise permanently joined to a head 9 of the tooth. There is a frusto-conical surface 11 between the head 9 and a shank 13. A groove 15 is in the shank 13 near the tooth second end 17.

Each chain link collar 19 has a first inner diameter 21 that is slightly larger than the diameter of the tooth head 9. The collar also has a second inner diameter 23 that is slightly larger than the diameter of the tooth shank 13. A frusto-conical surface 25 connects the collar inner diameters 21 and 23. When the tooth frusto-conical surface 11 is against the collar frusto-conical surface 25, the tooth groove 15 and the tooth second end 17 extend past the collar back end 27.

To retain the tooth 3 in the collar 19, a heavy C-shaped keeper ring 29 is employed. The keeper ring 29 has an inner diameter 31 that is normally slightly larger than the diameter of the groove 15, and an outer diameter 33 that is larger than the diameter of the collar inner diameter 23. The particular keeper ring shown has an opening defined by two radial end surfaces 35. The end surfaces 35 subtend an angle of approximately 90 degrees.

In operation, the chain links 1 are driven as an endless track into the earth. The teeth tips 7 and heads 9 contact and cut the soil and rocks to dig a trench in the earth. The clearances between the teeth 3 and the associated collars 19 enable the teeth to rotate about their longitudinal axes 5. That action prolongs tooth life. Eventually, however, the teeth tips 7 and heads 9 wear out, and the teeth must be replaced.

Figure 4A:
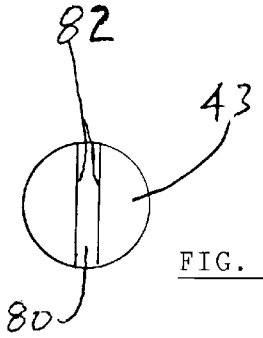
FIG. 4A is an enlarged view taken along line A—A of FIG. 5.
Figures 4, 5, 7, 9, 10:
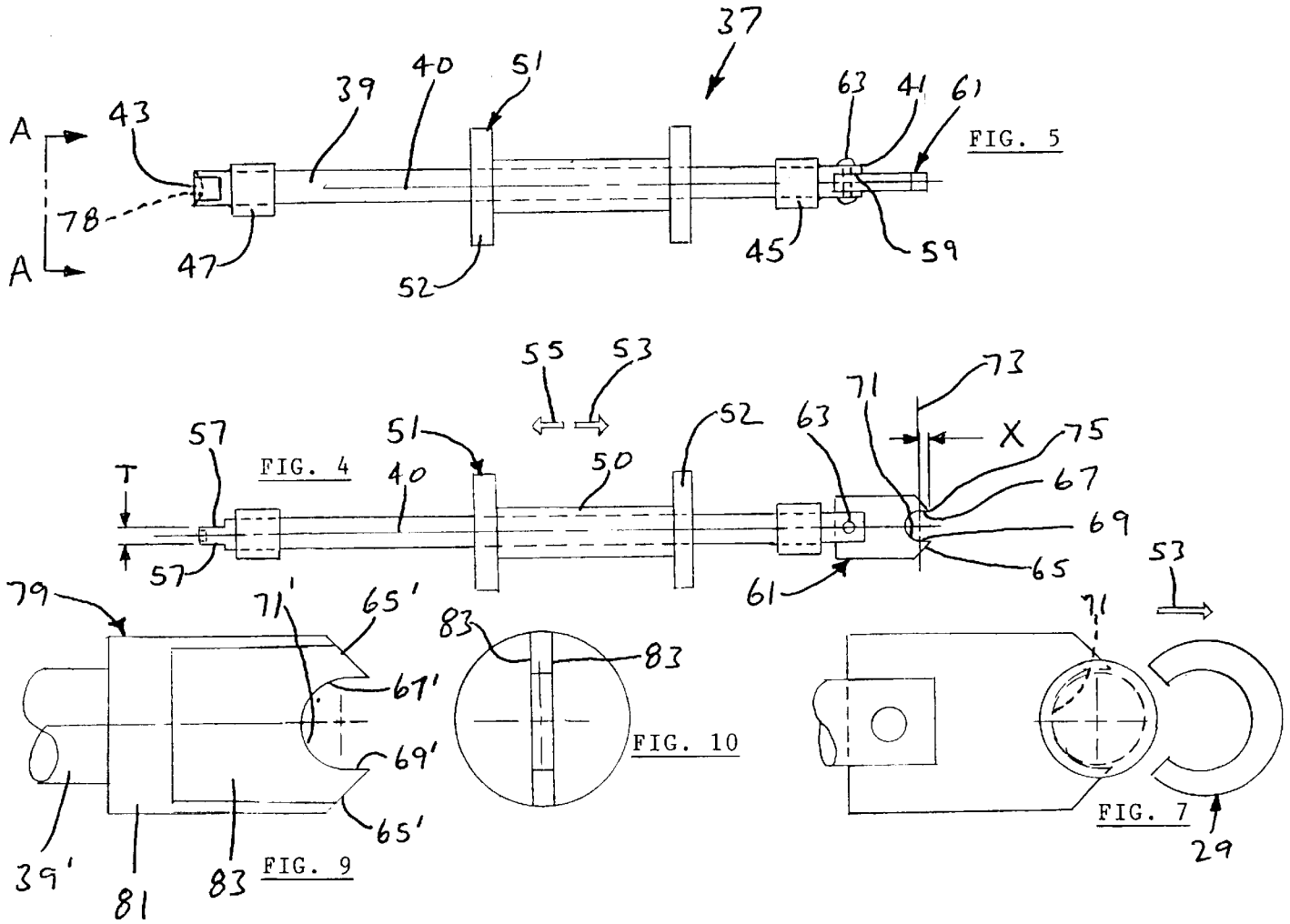
FIG. 4 is a front view of the present invention.
FIG. 5 is a top view of FIG. 4.
FIG. 7 is a view generally similar to FIG. 6, but showing the keeper ring removed from the tooth by using the present invention.
FIG. 9 is a partial view of a modified embodiment of the invention.
FIG. 10 is an end view of FIG. 9.

In accordance with the present invention, and looking at FIGS. 4, 4A, and 5, a slide hammer tool 37 greatly facilitates the removal of worn teeth 3 from and the installation of new teeth into the chain links 1. The slide hammer tool 37 is constructed with a long steel rod 39 having a longitudinal axis 40, a first end 41, and a second end 43. There is a first stop 45 proximate the rod first end 41 and a second stop 47 proximate the rod second end 43. The stops 45 and 47 are secured rigidly to the rod 39 by pins 49 or other fasteners.

A hammer 51 is slidable on the rod 39 in the directions of arrows 53 and 55. In the preferred embodiment, the hammer 51 has a cylindrical middle section 50 and large flanges 52 on both ends of the middle section. The travel of the hammer is limited by the stops 45 and 47.

In the illustrated construction, the rod first end 41 has a slot 59. One end of a steel wedge 61 is rigidly held in the slot 59 by one or more pins 63. The wedge 61 and slot 59 may have respective widths that are slightly less than the width of the tooth groove 15 (FIG. 2). The second end of the wedge defines a pair of surfaces 65 that are immoveable relative to each other and that converge toward the rod longitudinal axis 40. The converging surfaces 65 are at an included angle that is the compliment of the angle subtended by the keeper ring end surfaces 35 (FIG. 3).

There is a cutout 67 in the converging surfaces 65. The cutout 67 is preferably symmetrical about the rod longitudinal axis 40. The cutout 67 has opposed straight sides 69 that connect the converging surfaces with an arcuate surface 71. Preferably, the straight sides 69 are parallel. The radius of the arcuate surface 71 is preferably slightly larger than the radius of the groove 15 of the tooth 3 (FIG. 2). However, if desired, the radius of the arcuate surface 71 may be made slightly larger than the radius of the tooth shank 13. According to one aspect of the invention, the arcuate surface is continuous and uninterrupted. The center 73 of the cutout arcuate surface 71 is set back a distance X from a line through the intersections 75 of the cutout sides 69 with the converging surfaces 65. The surfaces 65 are hardened.

There is a concave surface in the rod second end 43 in the particular construction shown, the concave surface is in the form of an arcuate groove 78. The width of the arcuate groove 78 is slightly larger than the width of the keeper ring 29, and the depth of the groove is slightly less than the radial thickness of the keeper ring. The groove has a bottom surface 80 with a radius that is the same as the radius of the keeper ring outer diameter 33 (FIG. 2). A pair of parallel surfaces 82 intersect the groove bottom surface 80 and the second end 43. The rod second end is hardened and also magnetized. The rod 39 may be formed with opposed flats 57 adjacent the second end. The distance T between the flats 57 is larger than the width of the groove 78.

Figure 6:
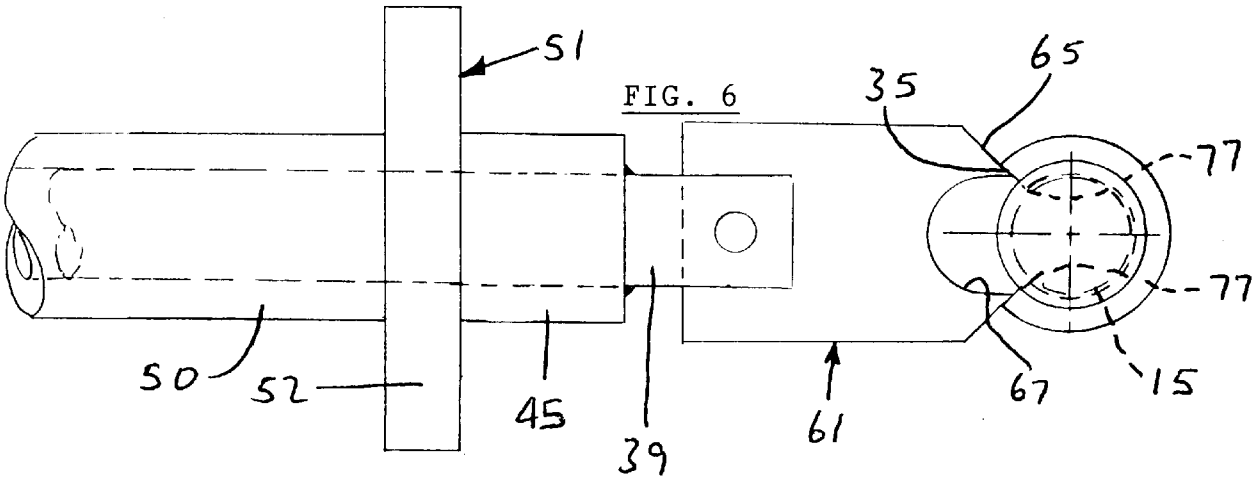
FIG. 6 is a partial view showing the present invention in use to remove a tooth from a chain link collar.

To use the slide hammer tool 37 to remove a worn tooth 3 from a chain link 1, a person places the converging surfaces 65 of the wedge 61 into abutting contact with the end surfaces 35 of the keeper ring 29. See FIG. 6. At the same time, the wedge cutout 67 passes a short distance over the tooth groove 15. See FIG. 6. The person grasps the middle section 50 of the hammer 51. He slides the hammer rapidly in the direction 53 until the hammer strikes the stop 45. The impact of the hammer on the stop 45 is transmitted through the rod 39 and converging surfaces 65 simultaneously to the keeper ring surfaces 35. The tooth groove 15 acts as a reaction member on the junctions 77 between the keeper ring inner diameter 31 and the end surfaces 35. The impact force of the immoveable converging surfaces 65 on the keeper ring surfaces 35 cooperates with the reaction force of the tooth groove on the keeper ring junctions 77 to expand the keeper ring junctions apart. The expansion of the keeper ring is sufficient to slide the junctions 77 over the groove diameter and push the keeper ring off the tooth in the direction 53. See FIG. 7. The wedge arcuate surface 71 contacts the tooth groove to limit any overtravel of the slide hammer tool in the direction 53 due to the impact of the hammer on the stop 45 after the keeper ring has been pushed off the tooth groove. The keeper ring removal process takes only a few seconds time. The large flanges 52 on the hammer protect the person's fingers during the removal process. In addition, the slide hammer tool occupies a minimum amount of space, so it is easily used adjacent the chain links 1 of a trenching machine.

Figure 8:
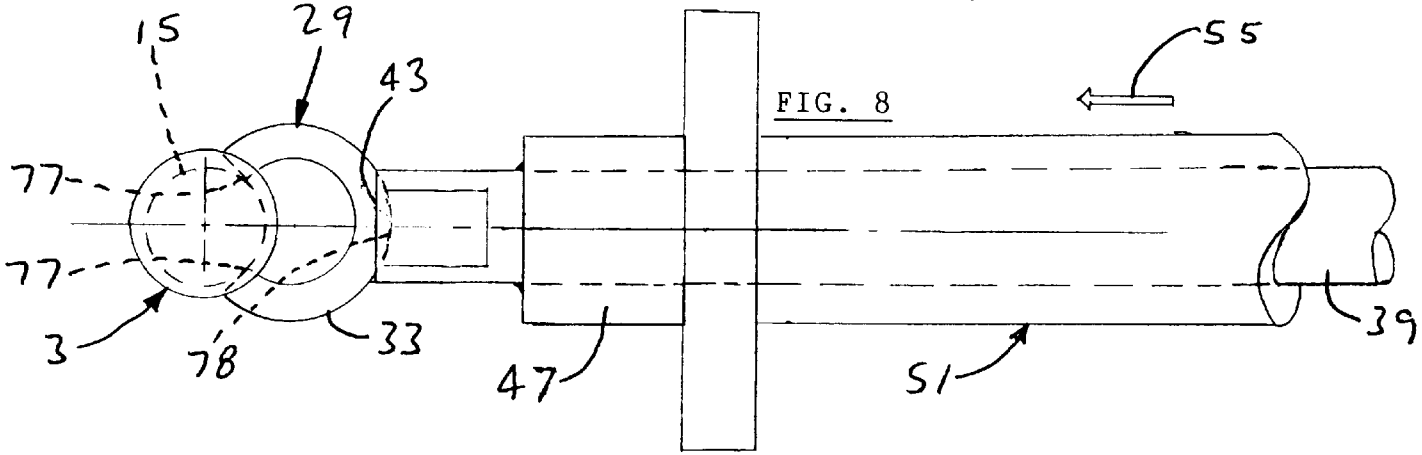
FIG. 8 is a view showing the present invention in use to install a tooth in a chain link collar.

After the keeper ring 29 is of f the worn tooth 3, the tooth is pulled from the chain link collar 19. A new tooth is inserted into the collar. The junctions 77 of the keeper ring are placed against the tooth groove 15, FIG. 8. The concave surface 78 of the tool second end is pressed in abutting contact against the keeper ring outer diameter 33. The person slides the hammer 51 rapidly in the direction 55 against the stop 47. The impact of the hammer on the stop 47 is transmitted through the rod bottom surface 80 to the keeper ring. The tooth groove acts as a reaction member against the keeper ring junctions. The impact force on the keeper ring outer diameter cooperates with the reaction force of the tooth groove to cause the keeper ring junctions 77 to expand an amount sufficient for the keeper ring to slide over the tooth groove. Then the keeper ring immediately collapses to its original shape, and it is seated on the tooth, FIGS. 2 and 3.

FIGS. 9 and 10 show a modified first end 79 of the rod 39'. The first end 79 is formed with an enlarged cylindrical portion 81 that is integral with the rod 39'. As shown, flats 83 are on the cylindrical portion 81. There are converging surfaces 65' that are immoveable to each other, a cutout 67' with opposed sides 69', and an arcuate surface 71' in the cylindrical portion 81 between the flats 83. The geometries and dimensions of the converging surfaces 65', cutout 67', sides 69', and arcuate surface 71' are the same as for the corresponding components of the wedge 61 described previously in connection with FIGS. 4 and 5. Similarly, the operation and functions of the modified embodiment of FIGS. 9 and 10 are identical to those of the wedge 61.

In summary, the results and advantages of earth trenching machines can now be more fully realized. The slide hammer tool 37 provides both rapid and safe removal of worn teeth 3 as well as equal ease in installing new teeth. This desirable result comes from using the combined functions of the hammer 51 and the stops 45 and 47. When a worn tooth is to be removed, the converging surfaces 65 are placed against the keeper ring end surfaces 35. The impact of the hammer on the stop 45 causes the wedge to expand the keeper ring 29 and push it off the tooth groove 15. Installing a new tooth requires merely that the rod end 43 be abutted against the keeper ring outer diameter 33. The impact of the hammer on the stop 47 causes the keeper ring to become seated in the tooth groove.

It will also be appreciated that in addition to the superior performance of the slide hammer tool, its construction is such as to be of modest cost in relation to the benefits it provides. In fact, the tool pays for itself very quickly by greatly reducing the time required to replace the trencher teeth compared with using prior tools and methods. Moreover, the rugged and simple design of the tool assures that it will give a long service life with minimal maintenance.

Thus, it is apparent that there has been provided, in accordance with the invention, a slide hammer tool that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A slide hammer tool for selectively removing an open keeper ring having an inner diameter, an outer diameter, and radial end surfaces between the inner diameter and the outer diameter from a cylinder of a predetermined radius, and for seating the keeper ring on the cylinder comprising:

a. an elongated rod made of a selected material and having first and second ends;

b. first and second stops on the rod proximate the rod first and second ends, respectively;

c. a hammer slidable on the rod between the first and second stops;

d. means for pushing the keeper ring off the cylinder in response to striking the hammer rapidly against the first stop, wherein the means for pushing the keeper ring off the cylinder comprises a pair of converging surfaces that are immoveable relative to each other on the rod first end that abut the keeper ring radial end surfaces and that remain at the respective locations relative to each other when the hammer strikes the first stop, the rod first end defining a cutout between the converging surfaces, the cutout having a continuous and uninterrupted arcuate surface of a radius slightly larger than the predetermined radius; and e. means for seating the keeper ring on the cylinder in response to striking the hammer rapidly against the second stop.

2. The slide hammer tool of claim 1 wherein the cutout further has a pair of opposed straight sides between the arcuate surface and the converging surfaces.

3. The slide hammer tool of claim 1 wherein the means for pushing the keeper ring off the cylinder comprises a wedge rigidly held to the rod first end, the wedge defining the pair of converging surfaces that abut the keeper ring radial end surfaces when the hammer strikes the first stop, and the wedge further defining the cutout in the converging surfaces that has the continuous and uninterrupted arcuate surface.

4. The slide hammer tool of claim 2 wherein the straight sides are parallel.

5. The slide hammer tool of claim 3 wherein the wedge further defines a pair of opposed sides connecting the arcuate surface with the converging surfaces.

6. The slide hammer tool of claim 1 wherein the hammer comprises a cylindrical middle section with opposed ends, and an enlarged flange at each end of the middle section.

7. The slide hammer tool of claim 1 wherein:

a. the means for seating the keeper ring comprises a groove in the rod second end, the groove having a bottom surface with a diameter substantially the same diameter as the keeper ring outer diameter, and a pair of parallel side surfaces that intersect the groove bottom surface and the rod second end, the groove bottom surface having a depth that is slightly less than the distance between the keeper ring inner diameter and outer diameter; and b. the rod material at the rod second end is magnetized.

8. In combination with a trenching machine having an endless track of chain links each with at least one collar, and a tooth with a cylindrical groove of a predetermined radius removably retained in said at least one collar by a keeper ring in the tooth groove, the keeper ring having radial end surfaces, an outer diameter, and a predetermined width, apparatus for selectively removing the keeper ring from the tooth groove and for seating the keeper ring in the tooth groove comprising:

a. an elongated rod having first and second ends;

b. means for producing first and second impacts on the rod;

c. means for transmitting the first impact to the keeper ring to push the keeper ring off the tooth groove and thereby enable the tooth to be removed from said at least one collar, wherein the means for transmitting the first impact to the keeper ring comprises a wedge rigidly held in the rod first end, the wedge defining a pair of surfaces at respective locations that are immoveable relative to each other and that converge at a predetermined angle and a cutout in the converging surfaces, the cutout having a continuous uninterrupted arcuate surface of a first radius at least as large as the predetermined radius, the wedge converging surfaces being placed in abutting contact with the keeper ring radial end surfaces when the first impact is produced on the rod, so that the first impact is transmitted to the wedge converging surfaces and then to the keeper ring radial end surfaces and the wedge converging surfaces remain immoveable relative to each other to push the keeper ring off the tooth groove in response to the first impact being produced on the rod; and d. means for transmitting the second impact to the keeper ring to seat the keeper ring in the tooth groove.

9. The combination of claim 8 wherein the means for producing first and second impacts on the rod comprises:

a. a first stop on the rod proximate the rod first end;

b. a second stop on the rod proximate the rod second end; and c. means for rapidly striking a selected one of the first and second stops and thereby producing the first and second impacts, respectively, on the rod, wherein the means for rapidly striking comprises a hammer slidable on the rod between the first and second stops, and wherein the hammer comprises a cylindrical middle section with opposed ends that slide on the rod, and flanges at the ends of the middle section.

10. The combination of claim 8 wherein the wedge further defines a pair of opposed parallel side surfaces in the cutout between the arcuate surface and the converging surfaces.

11. The combination of claim 8 where in:

a. the wedge converging surfaces intersect the cutout opposed side surfaces at a pair of junctions;

b. the cutout arcuate surface is a semi-circle having the first radius; and c. the first radius of the wedge arcuate surface has a center located at a distance from the junctions of the converging surfaces with the cutout opposed surfaces greater than the first radius.

12. The combination of claim 8 wherein the means for transmitting the second impact comprises an arcuate groove in the rod second end, the groove having a bottom surface of substantially the same diameter as the keeper ring outer diameter, and a pair of substantially parallel side surfaces between the rod second end and the groove bottom surface, the side surfaces being spaced apart a distance slightly greater than the keeper ring predetermined width.

13. In combination with a trenching machine having an endless track of chain links each with at least one collar, and a tooth with a cylindrical groove of a predetermined radius removably retained in said at least one collar by a keeper ring in the tooth groove, the keeper ring having radial end surfaces, an outer diameter, and a predetermined width, apparatus for selectively removing the keeper ring from the tooth groove and for seating the keeper ring in the tooth groove comprising:

a. an elongated rod having first and second ends;

b. means for producing first and second impacts on the rod;

c. means for transmitting the first impact to the keeper ring to push the keeper ring off the tooth groove and thereby enable the tooth to be removed from said at least one collar, wherein the means for transmitting the first impact to the keeper ring comprises a pair of surfaces on the rod first end that are immoveable relative to each other and that converge at a predetermined angle and that define a cutout in the converging surfaces having a continuous and uninterrupted arcuate surface between the converging surfaces of a radius at least as large as the predetermined radius, the converging surfaces being placed in abutting contact with the keeper ring radial end surfaces when the first impact is produced, so that the first impact is transmitted to the rod converging surfaces without relative movement therebetween and to the keeper ring radial end surfaces to push the keeper ring off the tooth groove in response to the first impact being produced on the rod; and d. means for transmitting the second impact to the keeper ring to seat the keeper ring in the tooth groove.

14. A method of replacing a worn tooth retained by a keeper ring having an outer diameter and an opening defined by two radial end surfaces in a chain link of a trenching machine comprising the steps of:

a. producing a first impact on the keeper ring radial surfaces sufficient to temporarily expand the keeper ring opening, and pushing the expanded keeper ring off the worn tooth comprising the steps of:

i. placing a pair of converging surfaces that are immovable relative to each other against a respective radial end surface of the keeper ring; and ii. transmitting the first impact to the converging surfaces and the abutting keeper ring radial end surfaces while maintaining the converging surfaces immoveable relative to each other;

b. removing the worn tooth from the chain link;

c. installing a new tooth in the chain link;

d. placing the keeper ring opening against the new tooth;

e. abutting a concave surface against the keeper ring outer diameter; and f. producing a second impact on the keeper ring outer diameter sufficient to temporarily expand the keeper ring opening, and seating the keeper ring on the new tooth.

15. The method of claim 14 wherein the step of placing a pair of converging surfaces comprises the steps of:

a. providing a wedge formed with the pair of converging surfaces and having a continuous and uninterrupted cutout between the converging surfaces; and b. placing the wedge converging surfaces against respective radial end surfaces of the keeper ring, and simultaneously receiving the worn tooth in the wedge cutout.

16. The method of claim 14 wherein:

a. the step of producing a first impact comprises the steps of:

i. providing a rod having a first stop proximate the converging surfaces;

ii. rapidly striking the first stop with a hammer and thereby producing the first impact on the rod; and iii. transmitting the first impact from the rod to the converging surfaces; and b. the step of placing a pair of converging surfaces comprises the steps of:

i. forming a first end of the rod proximate the first stop with the pair of converging surfaces and with a continues and uninterrupted cutout between the converging surfaces; and ii. placing the rod converging surfaces in abutting contact with a respective radial end surface of the keeper ring, and receiving the tooth in the cutout.

17. The method of claim 16 wherein:

a. the step of abutting a concave surface comprises the steps of:

i. providing the rod with an arcuate groove having a bottom surface with a diameter substantially the same diameter as the keeper ring outer diameter, and with a pair of substantially parallel side surfaces that intersect the bottom surface; and ii. placing a portion of the keeper ring between the rod groove side surfaces and abutting the groove bottom surface against the keeper ring outer diameter; and b. the step of producing a second impact comprises the steps of:

i. providing the rod with a second stop proximate the concave surface;

ii. rapidly striking the second stop with a hammer and thereby producing the second impact on the rod; and iii. transmitting the second impact from the rod to the arcuate groove.

18. A method of removing a keeper ring having an outer diameter of a first predetermined radius and an opening defined by two radial end surfaces from a cylinder of a second predetermined radius comprising the steps of:

a. producing a first impact simultaneously against the keeper ring radial end surfaces sufficient to expand the keeper ring, wherein the step of producing a first impact comprises the steps of:

i. abutting a pair of rigid converging surfaces at locations immoveable relative to each other against associated end surfaces of the keeper ring; and ii. transmitting the first impact to the converging surfaces and the keeper ring radial end surfaces while maintaining the locations of the converging surfaces relative to each other;

b. pushing the expanded keeper ring off the cylinder;

c. placing the keeper ring opening adjacent the cylinder;

d. abutting a concave surface against the keeper ring outer diameter comprising the steps of:

i. providing an arcuate groove on a rod second end having a bottom surface with a radius substantially equal to the first predetermined radius, and a pair of parallel side walls between the bottom surface and the rod second end; and ii. abutting the rod arcuate groove bottom surface against the keeper ring outer diameter with the keeper ring being partially between the groove side surfaces; and e. producing a second impact between the concave surface and the keeper ring outer diameter sufficient to temporarily expand the keeper ring opening; and f. seating the keeper ring on the cylinder.

* * * * *

UNITED STATES PATENT AND TRADEMARK OFFICE

CERTIFICATE OF CORRECTION

PATENT NO. : 6,711,791 B2
DATED : March 30, 2004
INVENTOR(S) : Hess, Clint W.

It is certified that error appears in the above-identified patent and that said Letters Patent is hereby corrected as shown below:

Title page,
Item [63], Related U.S. Application Data, should read:
-- Continuation-in-part of application No. 09/356,559, filed on 19 July 1999 --.

Column 1,
Line 5, after "Ser. No. 09/356,559" delete "filed Jan. 7, 1999," and substitute
-- filed Jul 19, 1999 --.

Signed and Sealed this

Twenty-seventh Day of September, 2005

JON W. DUDAS
*Director of the United States Patent and Trademark Office*